United States Patent [19]

Fitzpatrick

[11] 4,176,743

[45] Dec. 4, 1979

[54] PORTABLE DESK TOP TRAY

[76] Inventor: Thomas J. Fitzpatrick, 505 S. 150 Cir., Omaha, Nebr. 68154

[21] Appl. No.: 927,962

[22] Filed: Jul. 26, 1978

[51] Int. Cl.[2] ..... B43M 17/00

[52] U.S. Cl. ..... 206/214; 108/25; 211/13; 211/60 R; 211/50; 211/69.5; 206/564

[58] Field of Search ..... 211/13, 60 R, 69.1, 211/69.2, 69.4, 69.5, 50; 206/214, 215, 224, 234, 305, 371, 373, 425, 558, 562, 563, 564; 108/25, 90; D9/77, 78, 75, 92

[56] References Cited

U.S. PATENT DOCUMENTS

| | | | |
|---|---|---|---|
| D. 59,277 | 10/1921 | Plym | D19/78 X |
| D. 186,144 | 9/1959 | Daniels | D19/78 X |
| D. 250,270 | 11/1978 | Spellier | D19/78 X |
| 1,579,978 | 4/1926 | Vincia | 211/69.1 X |
| 2,172,172 | 9/1939 | Mount | 211/13 X |
| 2,548,289 | 4/1951 | Carraher | 211/13 |
| 2,637,299 | 5/1953 | Salkey | 206/214 |
| 2,720,189 | 10/1955 | Newman | 211/60 R X |
| 3,239,069 | 3/1966 | Hollins | 211/60 R |
| 3,329,277 | 7/1967 | Gaudino | 211/13 |
| 3,566,882 | 3/1971 | Schroeder | 108/26.2 X |

*Primary Examiner*—Donald F. Norton
*Attorney, Agent, or Firm*—Zarley, McKee, Thomte, Voorhees & Sease

[57] ABSTRACT

A portable desk top tray for organizing and arranging desk implements such as a tape dispenser, stapler, calendar and the like, includes a top surface supported above a desk top by at least a front wall. The top surface has several depressions. Each depression is adapted to receive a respective desk implement and is of a size and shape to laterally confine the respective implement against substantial horizontal movement. Several elongated sockets open through the front wall and extend rearwardly therefrom at positions laterally spaced from the depressions. The top surface may also be provided with an upright wall structure shaped to conform to another respective one of the desk implements for receiving the same. One of the sockets may be positioned below and laterally between the upright wall structure.

16 Claims, 6 Drawing Figures

PORTABLE DESK TOP TRAY

BACKGROUND OF THE INVENTION

This invention relates generally to a unitary storage facility for office supplies customarily kept at an office worker's desk and more particularly to a portable tray for organizing and arranging customary desk utensils in an attractive and conveniently accessible manner.

Practically every office worker is provided with numerous desk implements with which to carry out his or her duties. These generally include pens, pencils, paper clips, calendar, memo pads, and perhaps such paper handling equipment as a tape dispenser, stapler and staple remover. Other implements which an office worker may find to be necessary include a ruler, letter opener, pair of scissors, etc.

There are several problems relating to the distribution, transporting and storage of such implements. For example, when a new employee is hired, an office manager must take the time to select those implements which the employee will need and to have the numerous items delivered to the employee's work station. At the work station, the employee generally conceals the implements out of sight where they also happen to be less accessible. To arrange and maintain such implements in an organized fashion on the top of a desk without drawers is difficult because of the frequency of use of the implements. Furthermore, in moving from one work station to another, it is a tedious job for a worker to collect and transport the numerous implements used in his work.

Accordingly, it is an object of the present invention to provide a tray for organizing and arranging a plurality of desk implements in an attractive integral device.

Another object of the invention is to provide a portable tray capable of supporting a plurality of desk implements in an organized fashion thereon.

Another object of the invention is to provide a tray on which desk implements may be arranged in a readily accessible manner.

Another object of the invention is to provide an integral tray adapted for storing and arranging substantially all of the desk implements required by an office worker.

Another object of the invention is to provide a portable desk top tray which is light weight, compact and attractive.

Finally, it is an object of the invention to provide a tray for desk implements which is economical to manufacture, durable in use and refined in appearance.

SUMMARY OF THE INVENTION

The portable tray of the present invention is adapted for organizing and arranging a plurality of desk implements and includes a top surface with means for supporting it in spaced relation above a desk top or the like. Several depressions are formed in the top surface with each depression being adapted to receive a respective desk implements and being of a size and shape to laterally confine the respective implement against substantial horizontal movement. Several elongated sockets which open toward the front of the tray and extend rearwardly therefrom are positioned in laterally spaced relation from the depressions so that the overall height of the tray may be minimized. The depressions thus afford a specific designated place for each implement for storage in an organized fashion. The sockets are particularly suitable for receiving elongated implements such as pens, pencils, a ruler, letter opener, scissors and the like.

An upright wall means may be provided to extend upwardly from the top surface and conform to another selected one of the desk implements for storage above the top surface. The upright wall means are particularly suitable for storing memo sheets, pads and the like. By positioning one or more of the sockets below and within the lateral confines of the upright wall means, the storage capacity of the tray may be efficiently utilized.

One or more of the depressions may be provided with end portions which curve upwardly into engagement with the top surface to facilitate the removal of small implements such as paper clips and the like. A pair of upstanding inverted U-shaped guide members may be supported on the top surface for retaining the pages of a loose leaf calendar.

This invention consists in the construction, arrangement and combination of the various parts of the tray, whereby the objects contemplated are attained as hereinafter more fully set forth, specifically pointed out in the claims, and illustrated in the accompanying drawings.

DETAILED DESCRIPTION OF THE INVENTION

Figure 1:
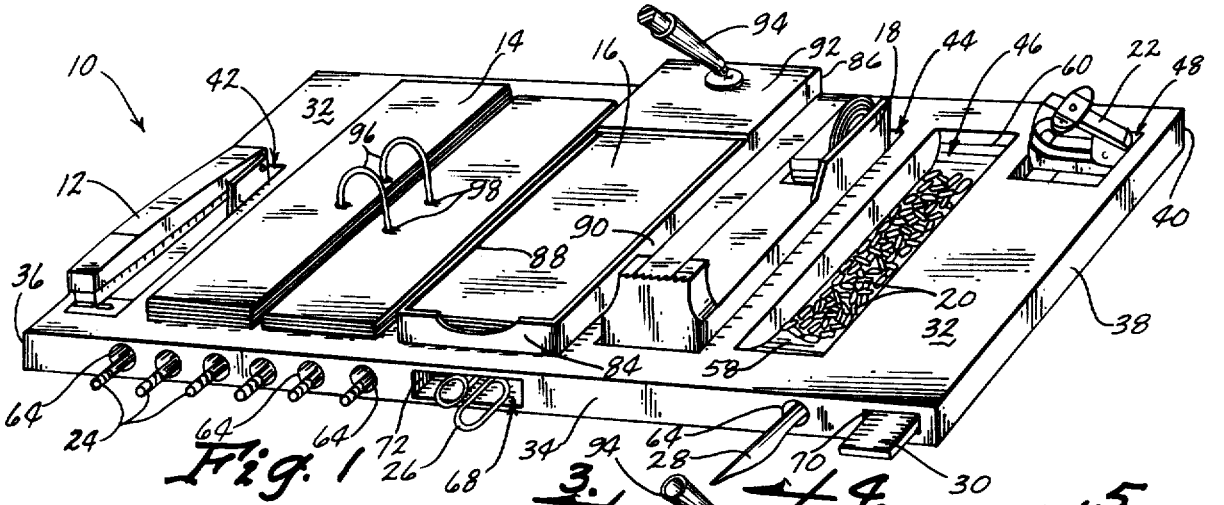
FIG. 1 is a perspective view of the portable desk top tray including a plurality of desk implements supported thereon.

A portable desk top tray, indicated generally at 10, is shown in FIG. 1 fully equipped with a supply of desk implements. These implements include a stapler 12, a loose-leaf calendar 14, memo sheets 16, a tape dispenser 18, paper clips 20 and a staple remover 22, all supported on top of the tray 10. There is also supported within the tray several pencils or pens 24, a pair of scissors 26, a letter opener 28 and a ruler 30.

Figure 2:
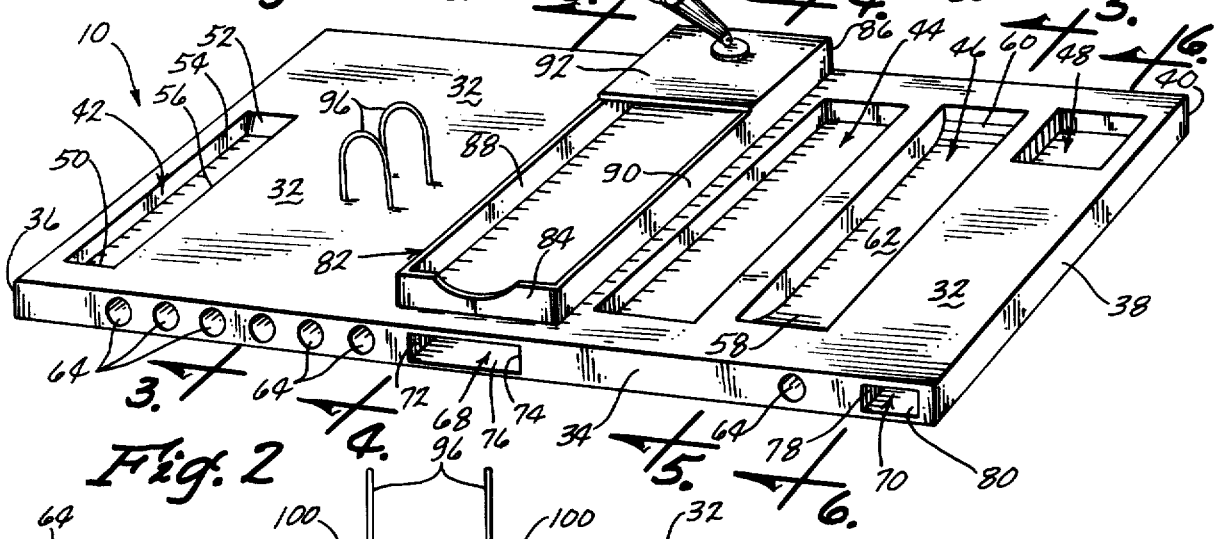
FIG. 2 is a perspective view of the portable desk top tray similar to FIG. 1 but without the desk implements.

In FIG. 2, the structure of the tray 10 is shown without the desk implements thereon. Tray 10 includes a top surface 32 which is supported in clearance relation above a supporting surface such as a desk top by a front wall 34, side walls 36 and 38 and a rear wall 40.

Several depressions or openings 42–48 are formed in the top surface 32. Each depression is adapted to receive a respective one of the desk implements and is of a size and shape to laterally confine the respective implement against substantial horizontal movement. For example, depression 42 has front and rear walls 50 and 52 which are only slightly wider than the base of stapler 12 and elongated side walls 54 and 56 which are only slightly longer than the base of stapler 12 such that the stapler is easily inserted into and removed from the depressions 42 yet substantially confined when situated in the depression 42. Likewise, depression 44 is adapted to receive the tape dispenser 18 in a similar manner.

Figure 5:
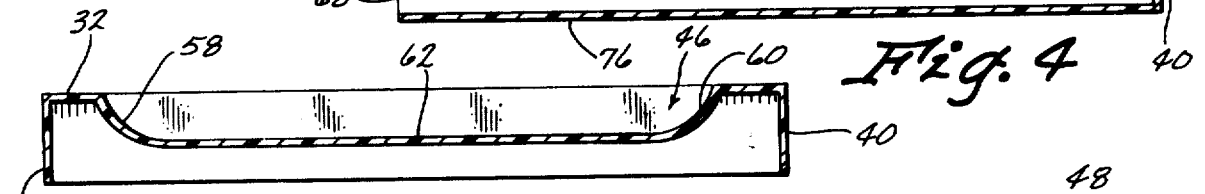
FIG. 5 is an enlarged detail sectional view showing the paper clip depression portion of the tray as seen on line 5—5 in FIG. 2.

Depression 46 is constructed somewhat different than the depressions 42 and 44 in that it includes opposite end portions 58 and 60 which curve upwardly from the bottom surface 62 into engagement with the top surface 32. This configuration facilitates removal of paper clips from the depression 46 by enabling one to slide an individual clip up the curved end portion 58, whereupon the upstanding end of the clip may be grasped. The depression 46 is further shown in side cross section in FIG. 5.

Figure 6:
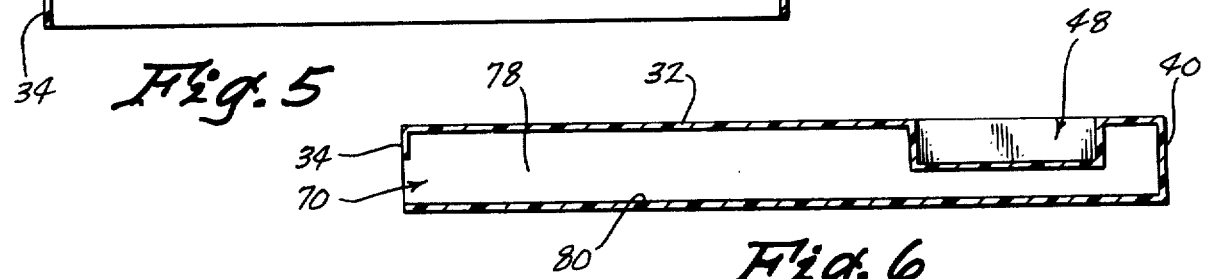
FIG. 6 is an enlarged detail sectional view of the tray taken along line 6—6 in FIG. 2.

Depression 48 is substantially square, having a length and width which is slightly greater than the length of the staple remover 22. Accordingly, although the staple remover is or irregular configuration, it can be easily received into depression 48 regardless of its orientation. Depression 48 is shown in side cross section in FIG. 6.

Figure 3:
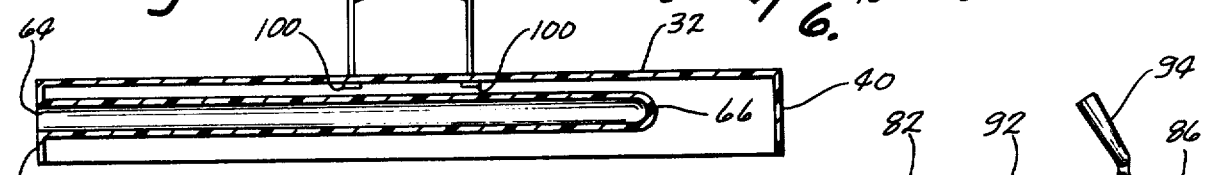
FIG. 3 is an enlarged detail sectional view through the calendar portion of the tray as seen on line 3—3 in FIG. 2.

Referring to FIGS. 1 and 3, a plurality of generally tubular elongated sockets 64 are shown which open at one end through front wall 34 and extend rearwardly therefrom. The rearward ends of the sockets are closed as at 66 (FIG. 3) to limit the extent to which a pen may be inserted therein. The socket 64 may be supported by means of the attachment to the front wall 34 as shown in FIG. 3 or braces suspended from the top surface 32 may be provided at positions closer to the rearward ends 66 for additional support.

A pair of wider sockets 68 and 70 of generally rectangular cross section are provided for receiving the scissors 26 and ruler 30 respectively. Socket 68 includes a pair of depending side walls 72 and 74 (not shown) which are connected at their bottom edges by a base plate 76. Likewise, socket 70 is defined by a depending side wall 78, tray side wall and a base plate 80. It may be desirable to provide base plates 76 and 80 as portions of a single base plate extended across the entire underside of the tray 10 or at least under that portion which includes both sockets 68 and 70.

Figure 4:
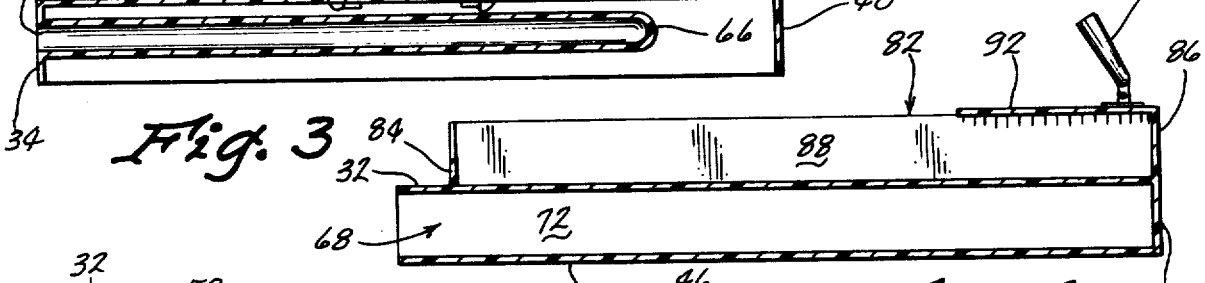
FIG. 4 is an enlarged detail sectional view of the memo holder portion of the tray as seen on line 4—4 in FIG. 2.

Upright wall means of a memo sheet holder 82 are shown in FIGS. 2 and 4. The memo sheet holder 82 includes front and rear walls 84 and 86 interconnected by longitudinally extended side walls 88 and 90 and a partial top cover over the rearward ends of the side walls for supporting a pen holder 94, name plate or the like. The walls of the memo sheet holder 82 are of a size and shape to receive and generally horizontally confine the memo sheets 16 therein.

A pair of inverted U-shaped calendar posts or guide members 96 are supported on the top surface 32 in spaced apart relation and at a position sufficiently spaced from depression 42 and the memo sheet holder 82 for receiving the loose-leaf pages of calendar 14 thereon. The loose-leaf pages have holes 98 positioned for receiving the guide members 96. The calendar sheets lie on the top surface 32 at both sides of the calendar posts 96 as shown in FIG. 1. The posts 96 are supported in their upright positions by brackets 100 on the underside of the top surface 32.

Tray 10 is preferrably formed of a light weight plastic material but may otherwise be constructed of any material which may be molded, stamped or assembled into the configuration of a tray as defined above. In certain embodiments, the top wall 32, support walls and depressions may be formed from an integral blank of sheet material. In other embodiments, the support walls 34–40, depression walls and memo sheet holder walls 84–90 may be bonded to the top wall 32 by the application of heat, an adhesive, or any other suitable means.

It is apparent that the specific arrangement of depressions and sockets shown in the drawing is not critical. Rather, the tray may be constructed to arrange the various implements in any convenient fashion. By arranging the sockets in laterally spaced relation from the depressions and perhaps below the memo sheet holder 82 as well, the overall height of the tray may be minimized and its storage capacity most efficiently utilized.

Thus there has been shown and described a light weight and attractive desk organizer tray capable of arranging and supporting substantially all of the desk implements commonly used by an office worker. The trays may be prepackaged in advance with a full set of desk implements so as to be available for distribution as a unit. Such a practice would substantially simplify the purchase, inventory and distribution of office supplies by an office manager, purchasing agent or the like.

I claim:

1. A portable desk top tray for organizing and arranging a plurality of desk implements, comprising a top surface having forward and rearward edges and laterally spaced apart opposite side edges, means for supporting said top surface in spaced relation above a desk top, said means including a front wall connected to said top surface and positioned adjacent the forward edge thereof, said top surface having a plurality of depressions, each depression being adapted to receive a respective desk implement and being of a size to generally laterally confine the respective implement against substantial horizontal movement when received in said depression, and a plurality of elongated sockets opening through said front wall and extended rearwardly therefrom, said sockets being positioned in laterally spaced relation from said depressions.

2. The structure of claim 1 further comprising upright wall means fixed to said top surface and extended upwardly therefrom, said upright wall means being shaped to conform to another respective one of said desk implements for receiving the same between said wall means.

3. The structure of claim 2 wherein at least one of said sockets is positioned below and laterally between said upright wall means.

4. The structure of claim 1 wherein at least one of said sockets is generally tubular.

5. The structure of claim 1 wherein at least one of said sockets is generally rectangular in cross section.

6. The structure of claim 1 wherein at least one of said depressions has an end portion which curves upwardly into engagement with said top surface.

7. In combination, a plurality of desk implements, a portable tray for organizing and arranging said implements, said tray including a top surface, means for supporting said top surface in spaced relation above a supporting surface, said top surface having a plurality of laterally spaced apart openings, each opening being adapted to receive a respective desk implement and being of a configuration to laterally confine the respective implement, when received therein, against substantial horizontal movement, and at least one elongated socket on said tray, said socket positioned below said top surface and laterally of said openings.

8. The combination of claim 7 wherein said tray further comprises upright wall means extended upwardly from said top surface and shaped to conform to another respective one of said desk implements.

9. The combination of claim 8 wherein at least one of said sockets is positioned below and laterally between said upright wall means.

10. The combination of claim 9 wherein said implements include a pair of scissors, and one of said sockets is of a length and width for receiving and supporting said pair of scissors.

11. The combination of claim 8 wherein said desk implements include a plurality of sheets of memo paper, said upright wall means being of a size and shape to receive and generally horizontally confine said sheets of memo paper therein.

12. The combination of claim 7 wherein at least one of said openings is of a shape which generally conforms to the outer peripheral shape of a respective one of said desk implements.

13. The combination of claim 7 wherein said desk implements include a tape dispenser and one of said openings is of a size and shape to receive and generally horizontally confine the tape dispenser therein.

14. The combination of claim 7 wherein said desk implements include a stapler and one of said openings is of a size and shape to receive and generally horizontally confine said stapler therein.

15. The combination of claim 7 wherein said desk implements include a plurality of paper clips and at least one of said openings has an end portion which curves upwardly into engagement with said top surface.

16. The combination of claim 7 including a pair of inverted U-shaped guide members supported on said top surface in spaced relation and said desk implements comprises a calendar having a plurality of pages with holes positioned for receiving said guide members.

* * * * *